US011045006B2

(12) United States Patent
Dolev et al.

(10) Patent No.: US 11,045,006 B2
(45) Date of Patent: Jun. 29, 2021

(54) FOOTSTOOL

(71) Applicants: Guy Dolev, Herzliya (IL); Idan Dolev, Herzliya (IL)

(72) Inventors: Guy Dolev, Herzliya (IL); Idan Dolev, Herzliya (IL)

( * ) Notice: Subject to any disclaimer, the term of this patent is extended or adjusted under 35 U.S.C. 154(b) by 0 days.

(21) Appl. No.: 16/571,121

(22) Filed: Sep. 15, 2019

(65) Prior Publication Data

US 2020/0093275 A1 Mar. 26, 2020

Related U.S. Application Data

(60) Provisional application No. 62/733,646, filed on Sep. 20, 2018.

(51) Int. Cl.

| | |
|---|---|
| ***A47C 16/02*** | (2006.01) |
| ***A47C 7/62*** | (2006.01) |
| ***A47C 7/74*** | (2006.01) |
| ***A47C 4/54*** | (2006.01) |

(52) U.S. Cl.

CPC ..... *A47C 16/02* (2013.01); *A47C 4/54* (2013.01); *A47C 7/622* (2018.08); *A47C 7/748* (2013.01)

(58) Field of Classification Search

CPC ..... A47C 16/02; A47C 7/622; A47C 7/748; A47C 4/54

USPC ..... 297/180.12

See application file for complete search history.

(56) References Cited

U.S. PATENT DOCUMENTS

| | | | | |
|---|---|---|---|---|
| 3,853,121 | A * | 12/1974 | Mizrachy | A61H 15/0078 601/48 |
| 6,406,098 | B1 * | 6/2002 | Linder | A47C 3/16 220/592.2 |
| 6,478,380 | B2 * | 11/2002 | Ehrlich | A47C 16/025 297/423.41 |
| 8,783,781 | B1 * | 7/2014 | McClure | A47C 1/0244 297/452.41 |
| 2002/0140272 | A1 * | 10/2002 | Ehrlich | A47C 16/025 297/423.44 |
| 2003/0047979 | A1 * | 3/2003 | Carom | A47C 16/02 297/423.45 |
| 2004/0070254 | A1 * | 4/2004 | Conlon | A47C 16/02 297/423.41 |
| 2006/0138297 | A1 * | 6/2006 | Esimai | A47B 23/002 248/346.01 |
| 2009/0189432 | A1 * | 7/2009 | Anikin | A47C 27/088 297/423.41 |
| 2010/0318004 | A1 * | 12/2010 | Numata | A61H 7/007 601/16 |
| 2016/0360937 | A1 * | 12/2016 | Naik | A45D 34/02 |
| 2018/0312093 | A1 * | 11/2018 | Vanel | B60N 2/0224 |
| 2018/0325277 | A1 * | 11/2018 | Perera | A47C 16/02 |
| 2019/0184883 | A1 * | 6/2019 | Zhong | B60N 2/26 |
| 2019/0380504 | A1 * | 12/2019 | Therkildsen | A47C 27/082 |

* cited by examiner

*Primary Examiner* — Mark R Wendell

(74) *Attorney, Agent, or Firm* — Alphapatent Associates, Ltd; Daniel J. Swirsky

(57) ABSTRACT

An inflatable footstool including a body made of flexible material, the body including a bottom surface and a leg supporting surface, the leg supporting surface being inclined with respect to the bottom surface, where the body forms an inner container filled with elastic compressible material, and an air valve coupled to the body, the air valve including an air inlet for sealing the inner container and for filling the inner container.

14 Claims, 4 Drawing Sheets

FOOTSTOOL

FIELD

The invention generally relates to a cushion apparatus and more particularly to an inflatable footstool for use as cushioned support for a user's legs.

BACKGROUND

Today in everyday life, many individuals spend a lot of time seated on a chair due to their occupation, leisure activities or long transportation time. In some cases, during the time seated on the chair the legs are inactive. In further cases, the situation that caused the prolonged seating may not allow or hardens the option to move the legs and activate the leg's muscles. A few examples comprise long distance flights, or when going on long train/bus trips, long working days in the office where a person is required to spend hours seating on a chair without much options for movements.

Prolonged sitting without movement of the legs may cause the thighs to apply pressure on the soft tissues that are situated behind/below the thighs as well as on the lower back and spine. In such cases, sitting on chairs for a long time may be uncomfortable, and may be accompanied by leg cramps, back pain and in some cases thrombus/blood clots and pressure ulcers. Furthermore, inadequate circulation of blood may occur in the lower legs during the prolonged duration of the sitting. In such cases, several harms may develop including venous ulcers, limb swelling and even venous stasis (or deep vein thrombosis—DVT—in particular).

There are many situations and leisure activities where a person must be seated for a long time on a chair without movement, such as flights, cars, buses, trains or any other transportation means or free time which require long sitting. During these long periods of time, many persons use leisure accessories such as: earphones, paper notes, pencils, batteries, portable media players helping them enjoy their time in a more comfortable and healthier way as well as need a single item to carry all these leisure accessories.

SUMMARY

In an embodiment of the invention an inflatable footstool is provided, including a body made of flexible material, said body includes a bottom surface and a leg supporting surface, said leg supporting surface is inclined with respect to the bottom surface, said body forms an inner container filled with elastic compressible material and an air valve coupled to the body, said air valve includes an air inlet for sealing the inner container and for filling the inner container.

In some embodiments, the elastic compressible material includes a memory foam.

In some embodiments, the inner container of the body includes an inflating capsule, said inflating capsule includes a chemical material which inflates in response to touching the footstool.

In some embodiments, the inflatable footstool further includes an operative electrical member, a power source coupled to the operative electrical member and an activation module coupled to the operative electrical member, said activation module is placed on a surface of the body.

In some embodiments, the inflatable footstool further includes two depressions placed on the leg supporting surface to accommodate the user's legs, and wherein the operative electrical member includes two massaging members coupled to the two depressions.

In some embodiments, the inflatable footstool further includes two depressions placed on the leg supporting surface to accommodate the user's legs, wherein the operative electrical member includes two heating members coupled to the two depressions.

In some embodiments, the operative electrical member includes at least one massaging member placed on the leg supporting surface. In some embodiments, the operative electrical member includes at least one heating member placed on the leg supporting surface. In some embodiments, the body includes a lateral surface, wherein the activation module is placed on the lateral surface. In some embodiments, the body includes a lateral surface including a plurality of pockets extending therefrom. In some embodiments, the bottom surface further includes at least one friction strip disposed thereon, wherein the at least one friction strip is formed from a material with high friction coefficient.

In some embodiments, the inner container includes a single cell that fills an entire volume of the inner container. In some embodiments, the he inner container includes multiple separate cells, wherein each cell includes a separate inflating element that inflates each cell separately.

In some embodiments, the inner container includes two or more inclination cells, wherein the two or more inclination cells are configured to form different wedge shapes for enabling a user to determine a desired inclination of the leg supporting surface.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DETAILED DESCRIPTION

The invention, in embodiments thereof, discloses an inflatable footstool for use in situations that require prolonged durations of sitting on a chair that comprises an elongated body having a bottom surface and a foot-supporting surface which is inclined with respect to the bottom surface or other means of stable surface. The inflatable footstool, also defined below as "footstool", may comprise an air-proof inner container filled with an elastic compressible material such as plastic foam and provided with a valve for sealing the interior of the inner container or for opening connection thereof to the atmosphere so that when the valve is opened, the plastic foam can be compressed for depleting air from the cells of the plastic foam with subsequent closing of the valve, whereby the footstool shrinks to become several times smaller in volume for convenience of storage, transportation and carrying. The mark "F" as appears at the figures indicates the front side of the footstool.

Figure 1:
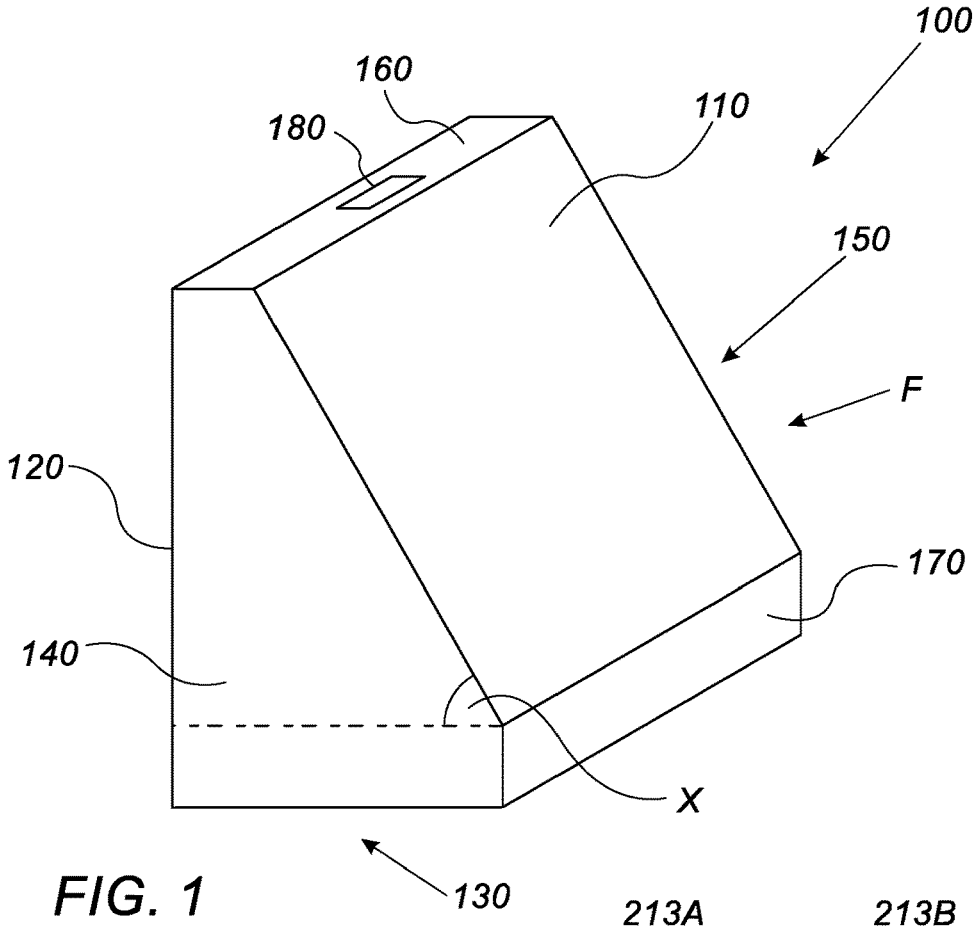
FIG. 1 discloses a footstool, according to exemplary embodiments of the invention.

FIG. 1 discloses a footstool, according to exemplary embodiments of the invention. FIG. 1 discloses a perspective illustration showing one exemplary embodiment of a footstool 100. In some embodiments of the invention, the footstool 100 comprises a body designed in a substantially wedge shape. The body may be designed in any polygonal, elliptical shape or a combination thereof. In some cases, the wedge shape is configured to provide an elevated position and support for the user's legs while the user sits on a chair. In some cases, the footstool 100 comprises a leg supporting surface 110, a rear surface 120, a bottom surface 130, a first lateral surface 140 a second lateral surface 150. In further cases, the footstool 100 further comprises a top surface 160 and a front surface 170. In some cases, the leg supporting surface 110 may be inclined with respect to the bottom surface 130, wherein the inclination is measured by an inclination angle X. In some cases, the inclination angle X may be in the range of 20-80 degrees. In some cases, the wedge shape provides the legs of a user with an elevated position for reducing the pressure applied by the user's thighs in cases of prolonged sitting.

In some cases, the surfaces of the footstool 100 are configured to provide some rigidity so that the footstool 100 may support the user's legs when the user rests his/her legs on the leg supporting surface 110. In some embodiments of the invention, the surfaces of the footstool 100 may be made from non-stretchable flexible material, such as rubberized fabric (e.g., viscose), plastic (e.g., polyvinylchloride) or reinforced rubber, fabrics, synthetic fabrics, recycled paper, and any material that can be used for textile and/or furniture desired by a person skilled in the art. For example, the footstool may be made from vinyl or another strong, durable plastic material. In some cases, the surfaces of the footstool 100 forms an inner container (not shown). In some cases, the surfaces of the footstool may be formed in a single molded structure in order to create the inner container. In other cases, the surfaces of the footstool may be manufactured as individual components and fused or glued together afterwards.

In some embodiments of the invention, the entire interior of the inner container is filled with foam (not shown). In some cases, the foam may be a memory foam such as polyurethane, sized to fill the entire interior volume of the inner container and which may be compressed to a much smaller size, for example the compressed footstool is 2-15% of the volume when inflated. In some cases, the inflating element (not shown) may be an air valve capable of either sealing the interior volume of the inner container or opening it to the surrounding atmosphere. In an exemplary embodiment, the footstool 100 may be inflated by enabling air to pass through the air valve, and fill the cells of the compressed foam thus filling the cells with air and self-inflating the footstool 100. Alternatively, a user may inflate the footstool 100 by blowing air through the air valve and into the inner container. The footstool 100 may be inflated via the air valve by mouth, by a small air compressor or by a manual air pump.

In some cases, the inflating element may be formed as an air valve capable of either sealing the interior of the inner container or opening it to the surrounding atmosphere. In such cases, the footstool 100 may be inflated by blowing air through the air valve and into the inner container. The air may be blown by a user using his/her mouth or using a compressor and the like. In other cases, an inflating capsule is disposed in the inner container of the footstool 100. The inflating capsule may comprise a predetermined amount of chemical material which inflates in response to pressing or touching an object in the footstool. In such cases, the inflating element may further comprise an air valve, for deflating or re-inflating the footstool 100.

In some embodiments of the invention, the footstool 100 may comprise a power source, configured to provide electrical power to components in the footstool 100 or to other electricity consumers. In some cases, the power source may be a disposable power source such as a non-rechargeable battery. In other cases, the power source may enable recharging thereof. In yet another cases, the power source may be embedded as a connection to an external power source.

Figure 2A:
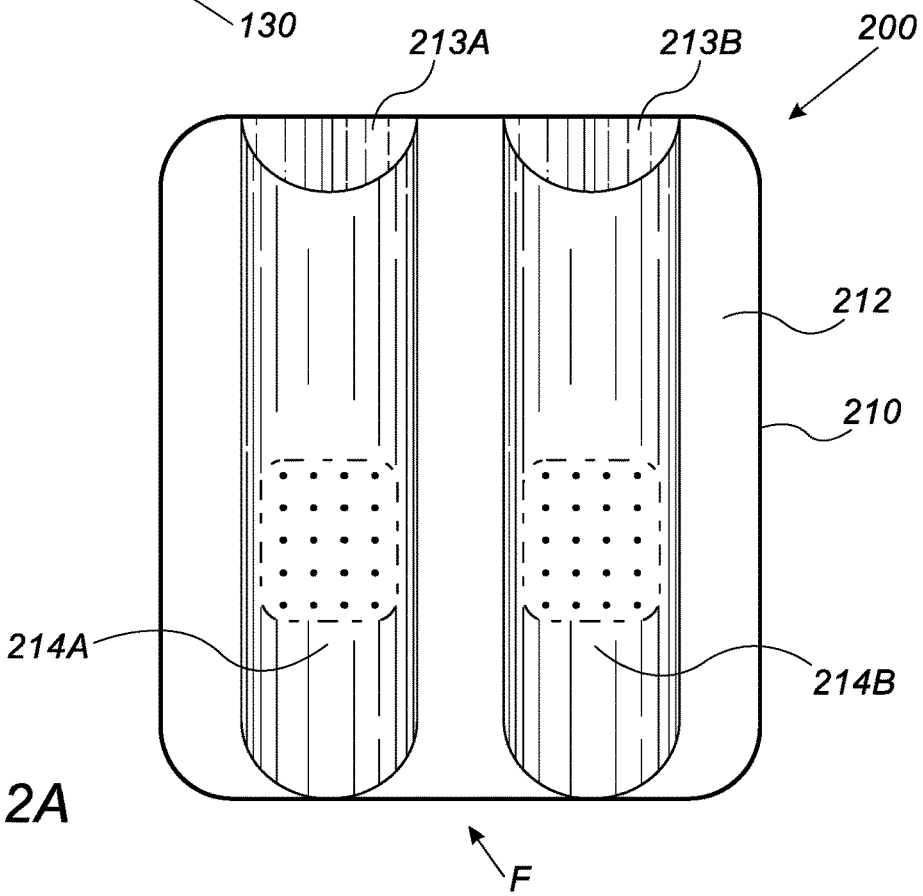
FIGS. 2A-2E show front elevation views of the exemplary surfaces the footstool, according to exemplary embodiments of the invention.

FIGS. 2A-2E show front elevation views of the exemplary surfaces of the footstool, according to exemplary embodiments of the invention. FIG. 2A shows a front elevation view of a front section 210 of a footstool 200. In some embodiments of the invention, the front section 210 comprises a leg supporting surface 212 and is configured to provide elevated position and support for the user's legs. In some cases, the front section 210 is configured to accommodate the calf parts of the user's legs (not shown) on the leg supporting surface 212 thereon. In some cases, a first and a second depressions 213A and 213B extend in an angular manner from the leg supporting surface 212 of the front section 210, to support the user's heels, or other parts of the foot, to reduce pressure from the user's leg muscles. In such cases, the first and the second depressions 213A and 213B may be designed in a cylinder manner to accommodate the user's foot. In some cases, the leg supporting surface 212 is formed from a soft material. In some cases, the leg supporting surface 212 may be formed from a memory foam.

In some embodiment of the invention, the first and the second depressions 213A and 213B may comprise a first member 214A and a second member 214B disposed therein, respectively. The first member 214A and the second member 214B may be used to massaging and/or heating. The massaging elements may be configured to massage the user's calves in order to enhance the blood flow in the user's legs. Applying pressure on the user's legs may mitigate the chances for DVT in cases of prolonged sitting. In some cases, the first member 214A and the second member 214B may be parallel to each other, and disposed at the same height. In some cases, the first member 214A and the second member 214B are disposed on the leg supporting surface 212, electrically or mechanically coupled to a mechanism located inside the footstool 200. The mechanism receives electrical power from the power source disclosed above. The mechanism is configured to apply pressure through the first member 214A and the second member 214B. For example, when the first member 214A and the second member 214B may be used to heat the user's legs, the members 214A and 214B may comprise a motor, a mount, a massage head and a track, wherein the motor is adapted to move a mount along the track which extends below the first member 214A and the second member 214B. The members 214A and 214B may be vibrating members, configured to stimulate blood flow in the user's leg. In such exemplary cases, the mount may engage the track such that movement of the mount along the track may be translated into movement of the massage head that applies force throughout his movement towards the first and the second members 214A and 214B. In some cases, the first and the second members 214A and 214B may comprises external massaging elements (not shown) that extend from the first and the second depressions 213A and 213B. When the members 214A and 214B are configured to heat the user's legs, for example in long train travels or when sitting in the office and the office volume cannot be heated for a reason. In such a case, heat emitting members are located on or near the front section 210.

In some exemplary cases, the leg supporting surface 210 may include a niche 180 configured to store an object, such as a book, phone, beverage container and the like. The niche 180 may be placed in the top surface such as the top surface 160 of FIG. 1, or closer to the legs, such as leg supporting surface 110 of FIG. 1. The niche 180 may have a cover, for example made of fabric. The cover may be attached to the surface around the niche, for example via Velcro or any other mechanism.

Figure 2B:
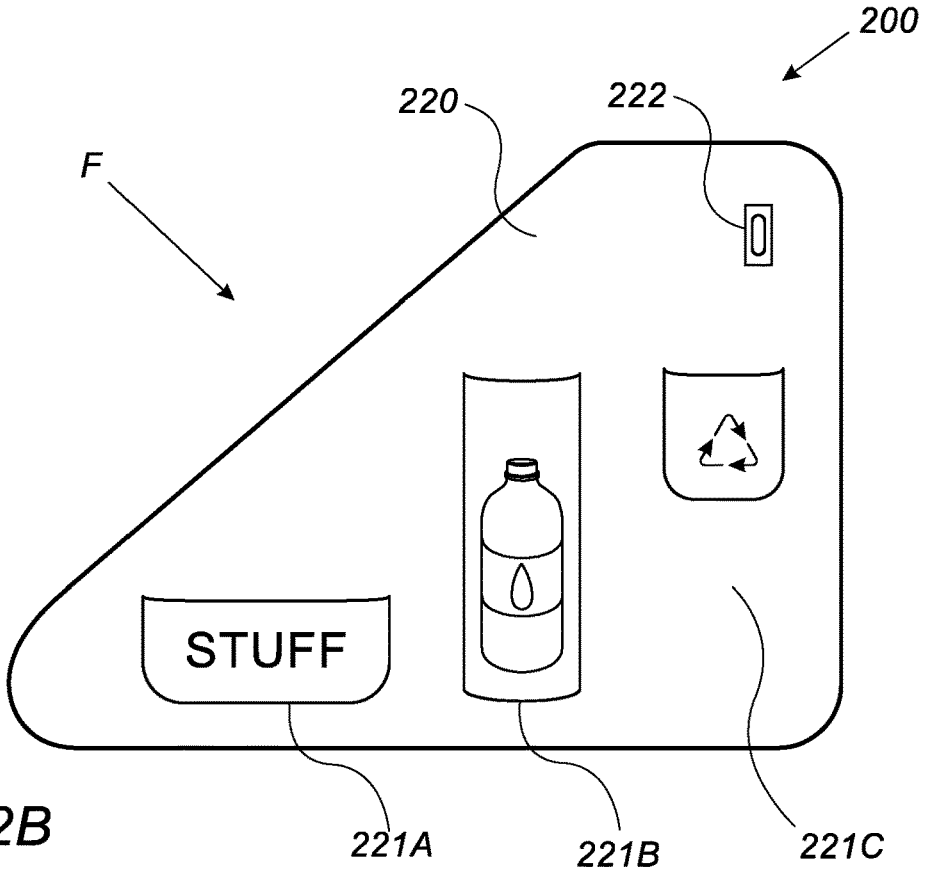

FIG. 2B shows a lateral view of an exemplary first lateral surface. FIG. 2B shows a first lateral surface 220, which is situated to the left of the leg supporting surface 210 of the footstool 200. In some cases, the first lateral surface 220 comprises a plurality of pockets 221A, 221B and 221C extending therefrom. The plurality of pockets 221A, 221B and 221C may be formed as an extension of the first lateral surface or connected thereto either permanently or temporarily. In some cases, the plurality of pockets 221A, 221B and 221C may be connected to the first lateral surface 220 by hook and loops fasteners, wherein the plurality of pockets 221A, 221B and 221C comprise a back surface with a hook strap and the first lateral surface comprises a hook strap on at least a portion thereof. The plurality of pockets 221A, 221B and 221C may be in a shape of cellular phones, chargers and the like. In some embodiments of the invention, an activation module 222 may be situated on the footstool 200. The activation module 222 may be a button, a switch, a knob and the like. In some cases, an activation module 222 may be situated on the first lateral surface 220, and may be configured to activate at least a portion of the electrical devices of the footstool 200. For example, the activation module 222 may be used to activate the internal mechanism that provides power to the first and the second members 214A and 214B. In some exemplary cases, the activation module 222 has 3 optional states—in the first state, none of the electrical components operate, in the second state, the footstool 200 massages the user's legs, and in the third state, the footstool 200 heats the user's legs and massages them. The footstool 200 may also comprise indication mechanism to indicate the activation module 222 state. The indication mechanism may be illumination, for example yellow color for phase 2 and no illumination for phase 1.

Figure 2C:
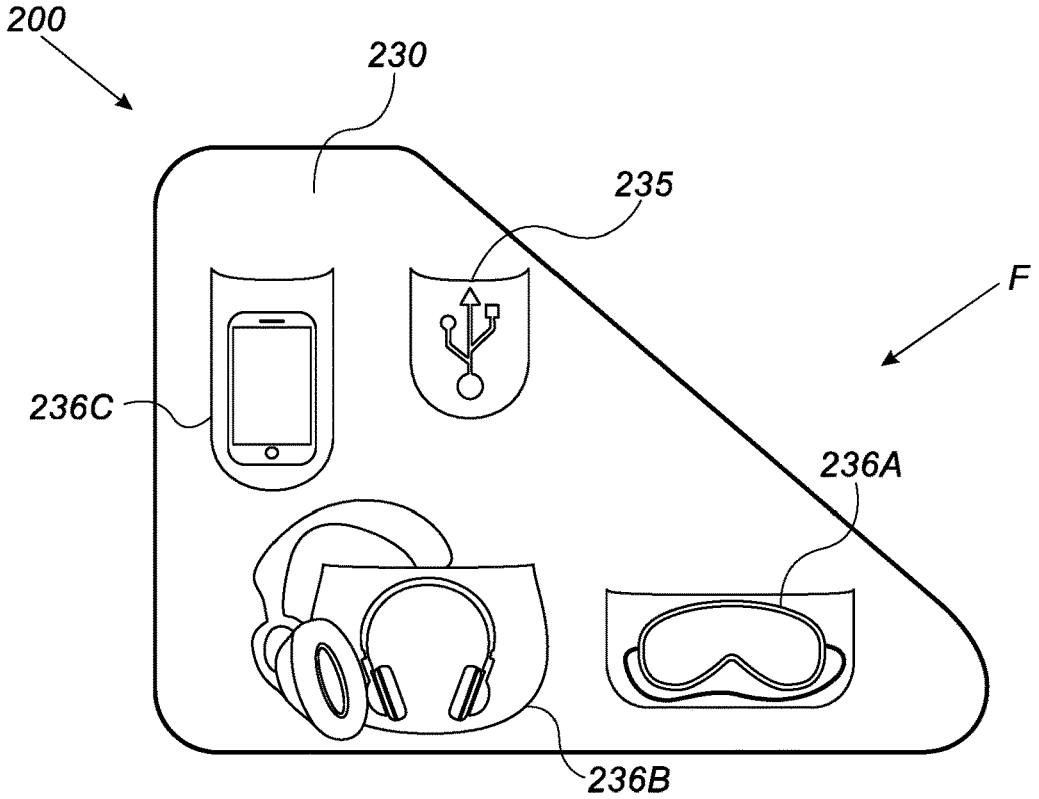

FIG. 2C shows a lateral view of an exemplary second lateral surface. FIG. 2C shows a second lateral surface 230, which is situated to the right of the front section 210 of the footstool 200. In some cases, the second lateral surface 230 may also comprises a plurality of pockets extending therefrom. In some embodiments of the invention, a charging socket 235 may be situated on the footstool 200. In some cases, the charging socket 235 may be situated on the second lateral surface 230, and may be configured to receive a first end of a charging connector (such as firewire or USB) for charging electrical devices that are connected to the other end thereof. In some cases, a plurality of pockets 236A-236C may be disposed on the second lateral surface 230 in a similar manner to the plurality of pockets 221A-221C on the first lateral surface 220.

Figure 2D:
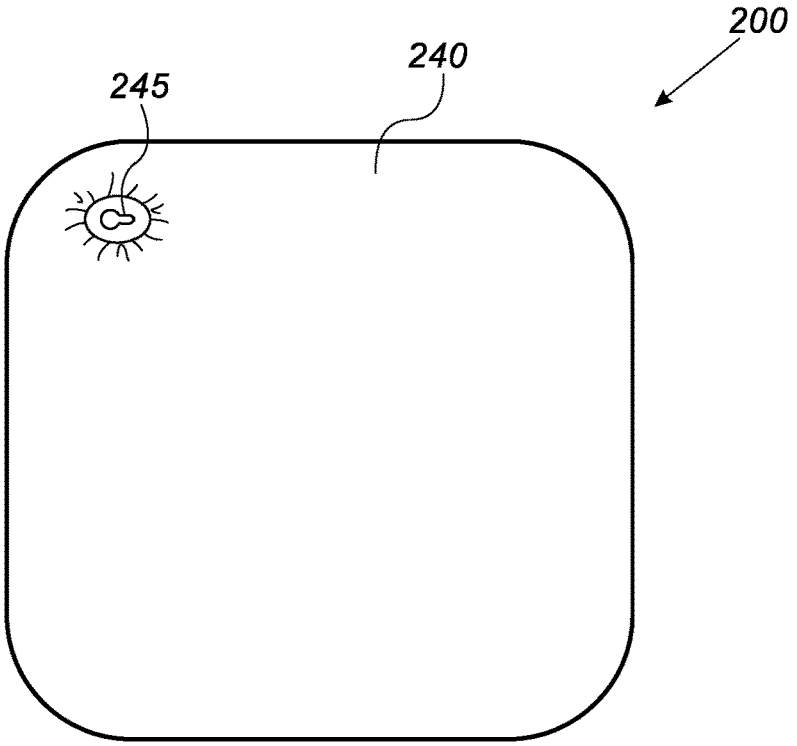
Figure 2E:
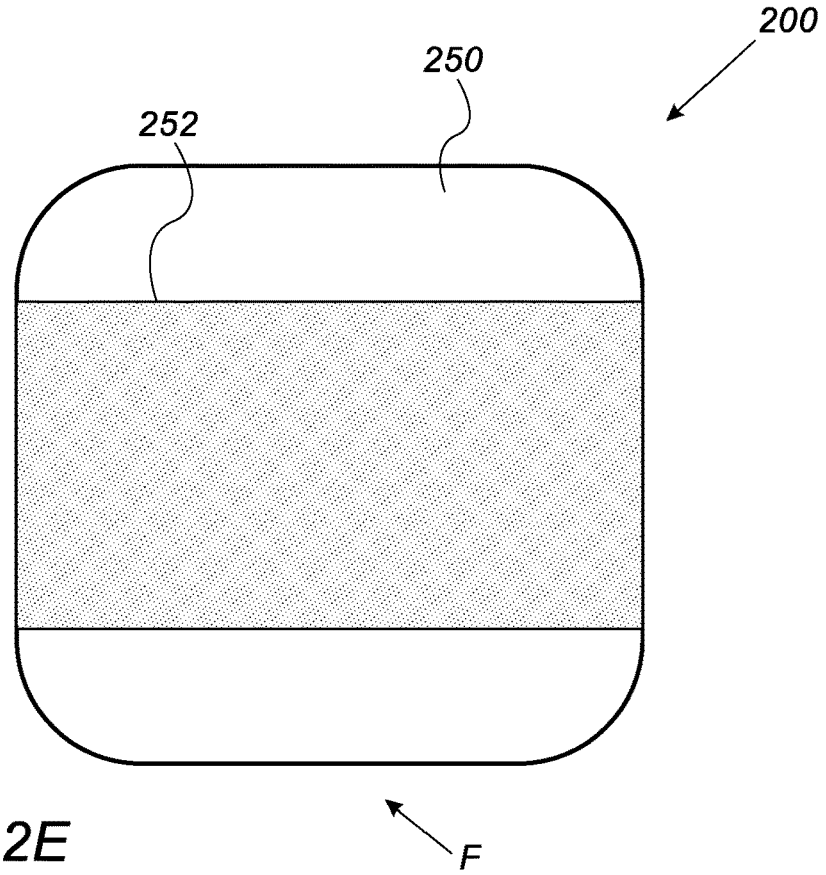

FIG. 2D shows a rear view of an exemplary rear surface. FIG. 2D shows a rear surface 240, which extends vertically upwards from the rear end of a bottom surface 250 of the footstool 200. In some cases, at least one inflating element may be disposed on or in the footstool 200. In some cases, the at least one inflating element may comprise an air valve 245, which extends through the rear surface 240 of the footstool 200, and enables air passage to and from the inner volume of the footstool 200. The air valve 245 comprises an air inlet via which air enters the inner volume. The user may place his/her mouth at the air inlet when pumping, or attach a pump outlet thereto. The pump outlet may be secured to the air inlet by a screw member or any other mechanism selected by the person skilled in the art. FIG. 2E shows a bottom view of an exemplary bottom surface. FIG. 2E shows a bottom surface 250, which extends throughout the bottom side of the footstool 200. In some cases, the bottom surface 250 is configured to be situated against the floor. In some cases, the bottom surface 250 extends through a single horizontal plane such that the bottom surface 250 may maintain contact throughout the entire surface thereof with the floor. In some cases, the at least one inflating element may be disposed on the bottom surface 250 of the footstool 200 instead on the rear surface 240. In some cases, the bottom surface 250 further comprises at least one friction strip 252 disposed thereon. In some cases, the at least one friction strip 252 may be formed from materials that enhance the friction coefficient of the strip (such as hook and loop formation) and/or formed from a material with high friction coefficient, as known to a person having ordinary skill in the art. The at least one friction strip 252 may be made of a material with a friction coefficient that prevents movement of the footstool on a carpet or a floor when the footstool is inflated.

Figure 3:
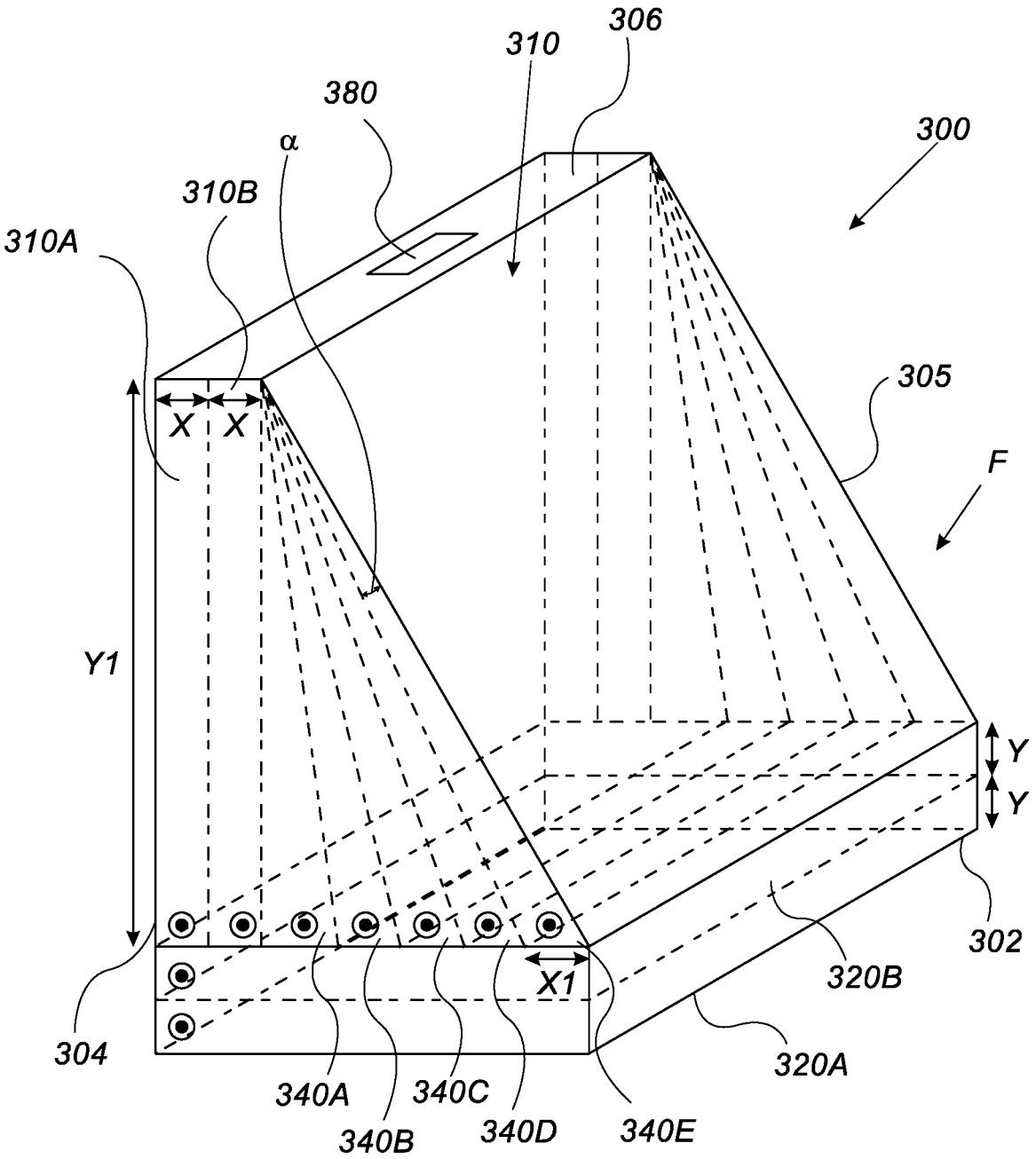
FIG. 3 discloses the interior of the footstool, according to exemplary embodiments of the invention.

FIG. 3 discloses the interior of the footstool, according to exemplary embodiments of the invention. FIG. 3 shows a footstool 300 comprising a leg supporting surface 305 with an inner container 310 marked with dashed lines. In some embodiments of the invention, the inner container 310 is created and defined by the surfaces of the footstool 300 and is configured to be air-tight. In some cases, the inner container 310 may comprise a single cell that fills the entire volume of the inner container 310. In such cases, inflating the inner container 310 causes the entire footstool 300 to form the wedge shape thereof and to provide support in the form of air inside the inner container 310. Also, deflating the inner container 310 causes the entire footstool 300 to shrink, lose the wedge form thereof, and to enable release all the air inside the inner container 310. In cases that the inner container 310 is deflated, the volume of the footstool 300 is greatly reduced, enabling the footstool to be folded and easily stored in a storage such as a bag, a pocket, a container and the like.

In some embodiments of the invention, the inner container 310 may comprise multiple cells that form the entire volume of the inner container 310. In some cases, the inner container 310 may comprise more than one cell. In such cases, each cell may comprise a separate inflating element that enables each cell to be inflated and/or deflated separately, regardless of the other cells. In some embodiments of the invention, the inner container 310 may comprise elevation cells, length cells and inclination cells. In some cases, elevation cells 320A and 320 B are configured to form a cushion like layer on the bottom of the inner container, elevating the leg supporting surface 305 from the ground. The inclination cells 330A, 330B, 330C, 330D and 330 E are configured to change the inclination angle of the leg supporting surface 305 and length cells 310A and 310B are configured to distance the leg supporting surface 305 from the rear surface of the footstool.

In some cases, the footstool 300 may comprise one or more elevation cells. In some cases, a leg supporting surface F of the footstool 300 may be formed from the front portion of the at least one elevation cell. In some cases, the elevation cells are configured to have a rectangular shape, which comprises a width and length which are identical to the width and length of the bottom surface and a height "Y". In such cases, elevation cells may be configured to be stacked one on top of the other. In some cases, each elevation cell may comprise different height. For example, the footstool 300 may comprise two elevation cells 320A and 320B. In some cases, each of the two elevation cells may comprise a height of Y and are configured to enables the leg supporting surface 305 to be situated in three possible heights relating to the bottom surface. In such exemplary cases, the leg supporting surface 305 may be situated in one of the below positions:

1) adjacent to the floor in cases that both elevation cells 320A and 320B are deflated;
2) at a first height Y in case either one of the elevation cells 320A and 320B is inflated and the other is deflated; and
3) at a second height 2Y in case both of the elevation cells 320A and 320B are inflated.

In some cases, the footstool 300 may comprise one or more length cells. In some cases, a top surface 306 of the footstool 300 may be formed from the top portion of the at least one length cell. In some cases, the length cells are configured to have a rectangular shape, having a width and height which are identical to the width and height of the rear surface and a length "X". In such cases, length cells may be configured to be stacked one next to the other and/or be connected to each other. In some cases, each elevation cell may have a different length. For example, the footstool 300 may comprise two length cells 330A and 330B. Also, each of the two elevation cells 320A and 320B may comprise a length of X and are configured to enable the leg supporting surface 305 to be situated in three possible lengths relative to the rear surface 304. In such exemplary cases, the leg supporting surface 305 may be situated in one of the below positions:

1) adjacent to the rear surface in cases that both length cells 330A and 330B are deflated;
2) at a first length X from the rear surface in case either one of the elevation cells 330A and 330B is inflated and the other is deflated; and
3) at a second length 2X from the rear surface in case both of the elevation cells 330A and 330B are inflated.

In some cases, the footstool 300 may comprise two or more inclination cells. In some cases, the inclination cells are configured to have different wedge shapes for enabling a user to determine the desired inclination of the leg support surface. In some cases, the inclination cells extend from the front edge of the top surface 306 (which in some cases may be also the rear surface top edge), to plane A, which extends from the front edge of the leg supporting surface 305 (which in some cases may be also the bottom surface front edge) and perpendicularly to the bottom surface. In some cases, the cross sections of the inclination cells may be triangular, and may comprise similar length (X1) and height (y1). In some cases, the inclination cells may comprise an identical top angle or different top angles. The top surface 306 may have a niche 380 as disclosed above. The niche 380 is configured to store an object, such as a book, phone, beverage or garbage container and the like. The niche 380 may be placed in the top surface such as surface 306 of FIG. 3. The niche 380 may have a cover, for example made of fabric (e.g., viscose), plastic (e.g., polyvinylchloride) or reinforced rubber, fabrics, synthetic fabrics, recycled paper, and any material that can be used for textile and/or furniture desired by a person skilled in the art.

For example, the footstool 300 may comprise five (5) inclination cells 340A-340E. Each of the inclination cells comprises an inclination cell rear surface and an inclination cell front surface. In such exemplary cases, the inclination cell 340A is the rearmost inclination cell and is connected at the inclination cell back surface thereof to the rear surface 304 of the footstool 300 or to the front surface of the front length cell. In some cases, inclination cell 340A is also connected to inclination cells 340B at the inclination cell front surface thereof. Inclination cell 340B is connected to inclination cell 340C and inclination cell 340C is connected to inclination cell 340D in the same manner. Inclination cell 340E is connected to the inclination cell front surface of inclination cells 340D at the inclination cell back surface thereof and to the leg support surface of the footstool 300 at the inclination cell front surface thereof. In some cases, each one of the inclination cells 340A-340E may comprise an inflating element that enables each of the inclination cells 340A-340E to be inflated and/or deflated regardless of the other inclination cells 340A-340E. In cases that the top angles of the inclination cells are different, the inclination cells are configured to enable a user to inflate any of the inclination cells 340A-340E and maintain the other inclination cells 340A-340E at a deflated state for determining the preferred inclination for the leg supporting surface 305.

While the invention has been described with reference to exemplary embodiments, it may be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the disclosed subject matter not be limited to the particular embodiment disclosed as the best mode contemplated for carrying out this invention.

What is claimed is:

1. An inflatable footstool for positioning the calf parts of a user's legs, comprising:

a body made of flexible material, said body comprises:
- a bottom surface;
- a leg supporting surface for positioning the calf parts of the user's legs, said leg supporting surface is inclined with respect to the bottom surface by an inclination angle of 45-80 degrees;
- a rear surface extending upwards from a rear end of the bottom surface;
- a top surface substantially parallel to the ground and extending between an upper end of the rear surface to an upper end of the leg supporting surface;
- a front surface extending downwards from a front end of the leg supporting surface to a front end of the bottom surface,
  - wherein the leg supporting surface extends downwards from the front end of the top surface to the upper end of the front surface, and
  - wherein said body forms an inner container filled with elastic compressible material; and an air valve coupled to the body, said air valve comprises an air inlet for sealing the inner container and for filling the inner container.

2. The inflatable footstool of claim 1, wherein the elastic compressible material comprises a memory foam.

3. The inflatable footstool of claim 1, further comprises an operative electrical member, a power source coupled to the operative electrical member and an activation module coupled to the operative electrical member, said activation module is placed on a surface of the body.

4. The inflatable footstool of claim 3, further comprises two depressions extending from the leg supporting surface to accommodate the user's legs, and wherein the operative electrical member comprises two massaging members coupled to the two depressions.

5. The inflatable footstool of claim 3, further comprises two depressions extending from the leg supporting surface to accommodate the user's legs, wherein the operative electrical member comprises two heating members coupled to the two depressions.

6. The inflatable footstool of claim 3, wherein the operative electrical member comprises at least one massaging member placed on the leg supporting surface.

7. The inflatable footstool of claim 3, wherein the operative electrical member comprises at least one heating member placed on the leg supporting surface.

8. The inflatable footstool of claim 3, wherein the body comprises a lateral surface, wherein the activation module is placed on the lateral surface.

9. The inflatable footstool of claim 1, wherein the body comprises a lateral surface comprising a plurality of pockets extending therefrom.

10. The inflatable footstool of claim 1, wherein the bottom surface further comprises at least one friction strip disposed thereon, wherein the at least one friction strip is formed from a material with high friction coefficient.

11. The inflatable footstool of claim 1, wherein the inner container comprises a single cell that fills an entire volume of the inner container.

12. The inflatable footstool of claim 1, wherein the inner container comprises multiple separate cells, wherein each cell comprises a separate inflating element that inflates each cell separately.

13. The inflatable footstool of claim 1, wherein the inner container comprises two or more inclination cells, wherein the two or more inclination cells are configured to form different wedge shapes for enabling a user to determine a desired inclination of the leg supporting surface.

14. The inflatable footstool of claim 1, wherein having an inflated state and a deflated state, wherein a volume in the inflated state is at least 5 times larger than a volume in the deflated state.

* * * * *